US008245856B1

(12) United States Patent
Pappin et al.

(10) Patent No.: US 8,245,856 B1
(45) Date of Patent: Aug. 21, 2012

(54) REMOTE CONTROL CAR SUPPORT APPARATUS

(76) Inventors: Clint G. Pappin, Ajax (CA); Louise Pappin, Ajax (CA)

( * ) Notice: Subject to any disclaimer, the term of this patent is extended or adjusted under 35 U.S.C. 154(b) by 300 days.

(21) Appl. No.: 12/580,776

(22) Filed: Oct. 16, 2009

(51) Int. Cl.
*A47F 7/00* (2006.01)

(52) U.S. Cl. ..... 211/13.1; 269/17; 254/122

(58) Field of Classification Search ..... 211/13.1, 211/20, 22, 23, 24, 17, 204, 206, 175; 269/55, 269/71, 17; 254/133 R, 122, 2 B, 10 B; 248/676
See application file for complete search history.

(56) References Cited

U.S. PATENT DOCUMENTS

| | | | | |
|---|---|---|---|---|
| 1,481,503 | A * | 1/1924 | Carswell et al. | 269/61 |
| 1,823,204 | A * | 9/1931 | Long | 269/60 |
| 2,955,632 | A * | 10/1960 | Stone | 269/17 |
| 3,405,781 | A | 10/1968 | Brown | |
| 3,977,662 | A * | 8/1976 | Cook | 269/60 |
| 4,183,511 | A * | 1/1980 | Marek | 269/17 |
| 4,239,197 | A * | 12/1980 | Olstad | 269/68 |
| D281,072 | S | 10/1985 | Hunt | |
| 4,594,882 | A | 6/1986 | Wheeler | |
| 4,599,034 | A | 7/1986 | Kennedy et al. | |
| 4,843,895 | A | 7/1989 | Harper et al. | |
| 4,932,639 | A * | 6/1990 | Fjellstrom | 269/17 |
| 5,707,450 | A * | 1/1998 | Thompson | 118/500 |
| 6,024,348 | A * | 2/2000 | Ventura et al. | 269/17 |
| 6,494,327 | B2 * | 12/2002 | Huang | 211/17 |
| 7,237,758 | B2 * | 7/2007 | Nikolic | 248/676 |
| 2003/0062663 | A1 * | 4/2003 | Fox | 269/17 |
| 2004/0060878 | A1 * | 4/2004 | Ho | 211/17 |

* cited by examiner

*Primary Examiner* — Sarah Purol
*Assistant Examiner* — Patrick Hawn

(57) ABSTRACT

The remote control car support apparatus supports a remote control (RC) car. The height of the apparatus can be adjusted for a total height of up to 16 inches. The length of the apparatus can be adjusted to accommodate various sizes of RC cars, from about $1/10^{th}$ scale to about $1/5^{th}$ scale, with an overall length adjustable up to about 27 inches. The apparatus features a total width of about 12 inches so that an RC car is not likely to tumble over when held. The apparatus provides for a full 360 degrees of rotation of a car, with the rotation locked in position as chosen. With these features, all facets of an RC car are accessible, allowing a hobbyist to work on the car as chosen. The plurality of mount holes in the adjustably positioned mounts allow for a car to be held to the apparatus as chosen.

1 Claim, 5 Drawing Sheets

REMOTE CONTROL CAR SUPPORT APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Remote control cars are enjoyed by many. The $1/10^{th}$ to $1/5^{th}$ scale cars are typically quite complex. Most hobbyists work on them, whether during assembly or maintenance, for repairs, or just changing parts. In the past, either the cars were held in one hand while worked on with the other, or placed upon a surface while worked on. Barring either of these actions, a second person was often needed to hold a car. None of these methods is satisfactory. The present apparatus provides a support stand that adjusts for car size, car support height, and rotates so that even the underside of the car is accessible

FIELD OF THE INVENTION

The remote control car support apparatus relates to remote control cars and more especially to a support apparatus that adjusts for car size, adjusts for height placement of the car, and provides for a full 360 degrees of car rotation.

SUMMARY OF THE INVENTION

The general purpose of the remote control car support apparatus, described subsequently in greater detail, is to provide a remote control car support apparatus which has many novel features that result in an improved remote control car support apparatus which is not anticipated, rendered obvious, suggested, or even implied by prior art, either alone or in combination thereof.

To attain this, the remote control car support apparatus supports a remote control (RC) car. The height of the apparatus can be adjusted for a total height of up to 16 inches. The length of the apparatus can be adjusted to accommodate various sizes of RC cars, from about $1/10^{th}$ scale to about $1/5^{th}$ scale, with an overall length adjustable up to 27 inches. The apparatus features a total width of about 12 inches so that an RC car is not likely to tumble over when held. The apparatus provides for a full 360 degrees of rotation of a car, with the rotation locked in position as chosen. With these features, all facets of an RC car are accessible, allowing a hobbyist to work on the car as chosen. The plurality of mount holes in the adjustably positioned mounts allow for a car to be held to the apparatus as chosen.

Thus has been broadly outlined the more important features of the improved remote control car support apparatus so that the detailed description thereof that follows may be better understood and in order that the present contribution to the art may be better appreciated.

An object of the remote control car support apparatus is to support a remote control car.

Another object of the remote control car support apparatus is to adjust to fit various sizes of remote control cars.

A further object of the remote control car support apparatus is to adjustably position the height at which a remote control car is supported.

An added object of the remote control car support apparatus is to provide rotation of the supported remote control car.

These together with additional objects, features and advantages of the improved remote control car support apparatus will be readily apparent to those of ordinary skill in the art upon reading the following detailed description of presently preferred, but nonetheless illustrative, embodiments of the improved remote control car support apparatus when taken in conjunction with the accompanying drawings.

In this respect, before explaining the current embodiments of the improved remote control car support apparatus in detail, it is to be understood that the remote control car support apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved remote control car support apparatus. It is therefore important that the claims be regarded as including such equivalent constructions insofar as they do not depart from the spirit and scope of the remote control car support apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the remote control car support apparatus generally designated by the reference number 10 will be described.

Figure 3:
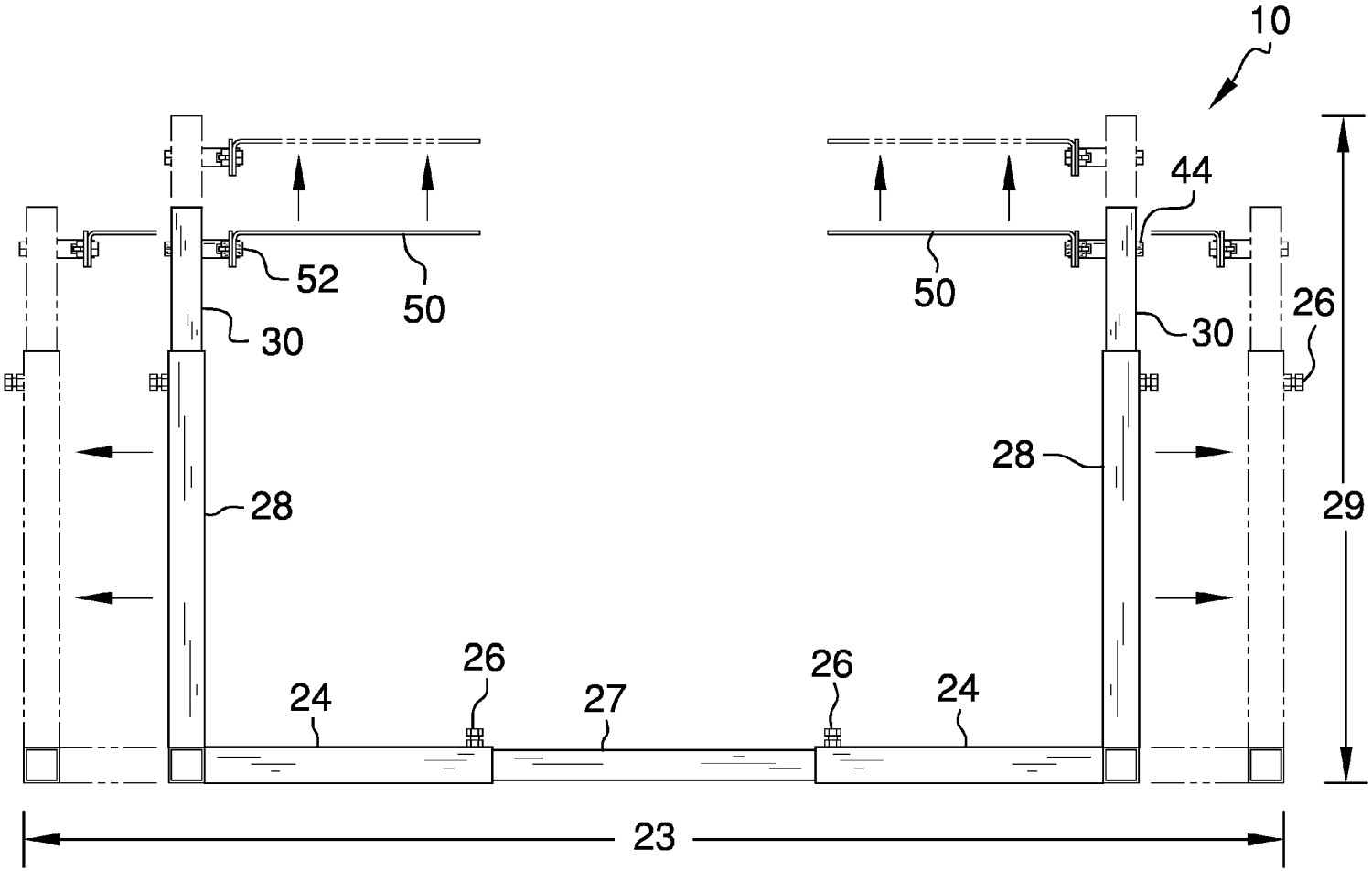
FIG. 3 is a lateral elevation view.
Figure 4:
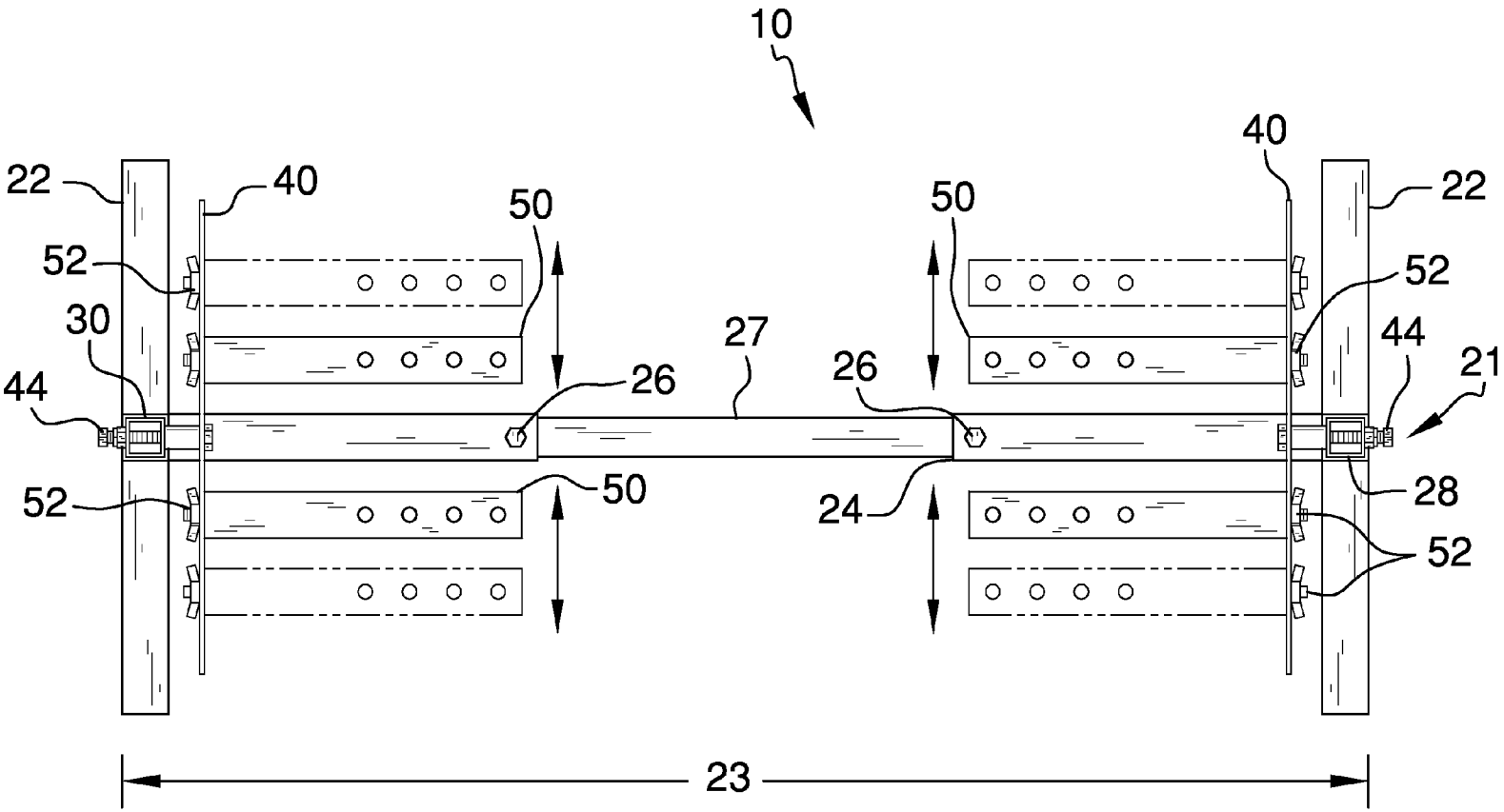
FIG. 4 is a top plan view.
Figure 5:
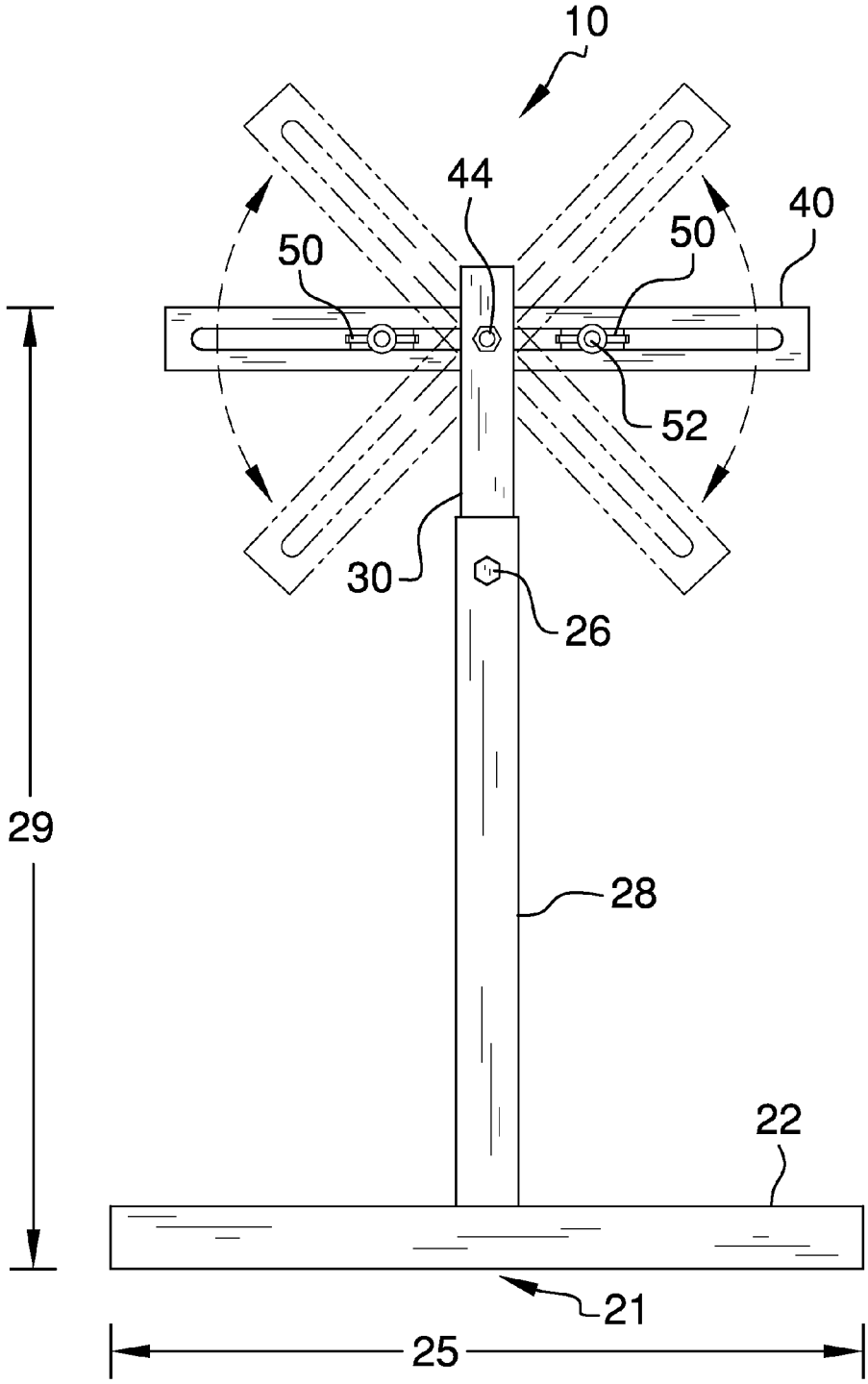
FIG. 5 is an end elevation view.

Referring to FIGS. 3, 4 and 5, the apparatus 10 comprises a length 23 adjustable to about 27 inches, a width 25 of about 12 inches, and a height 29 adjustable up to about 16 inches.

Figure 1:
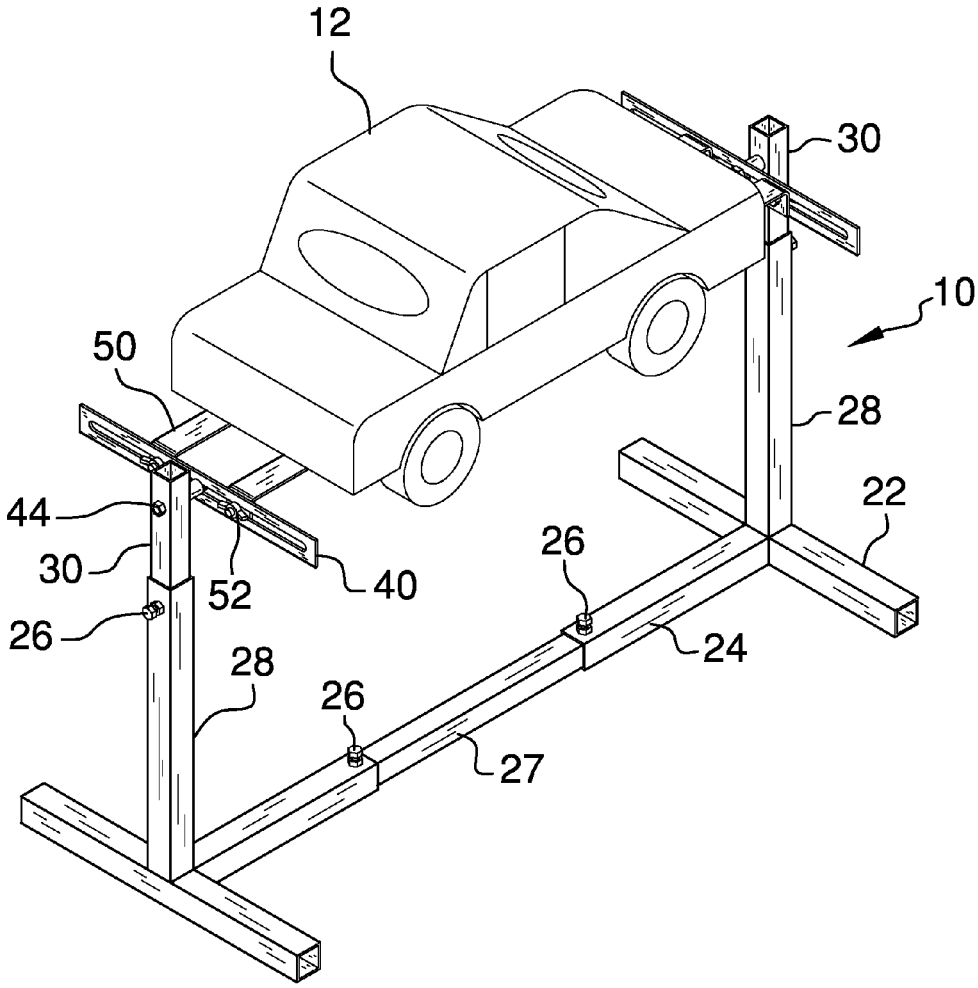
FIG. 1 is a perspective view of the apparatus in use.
Figure 2:
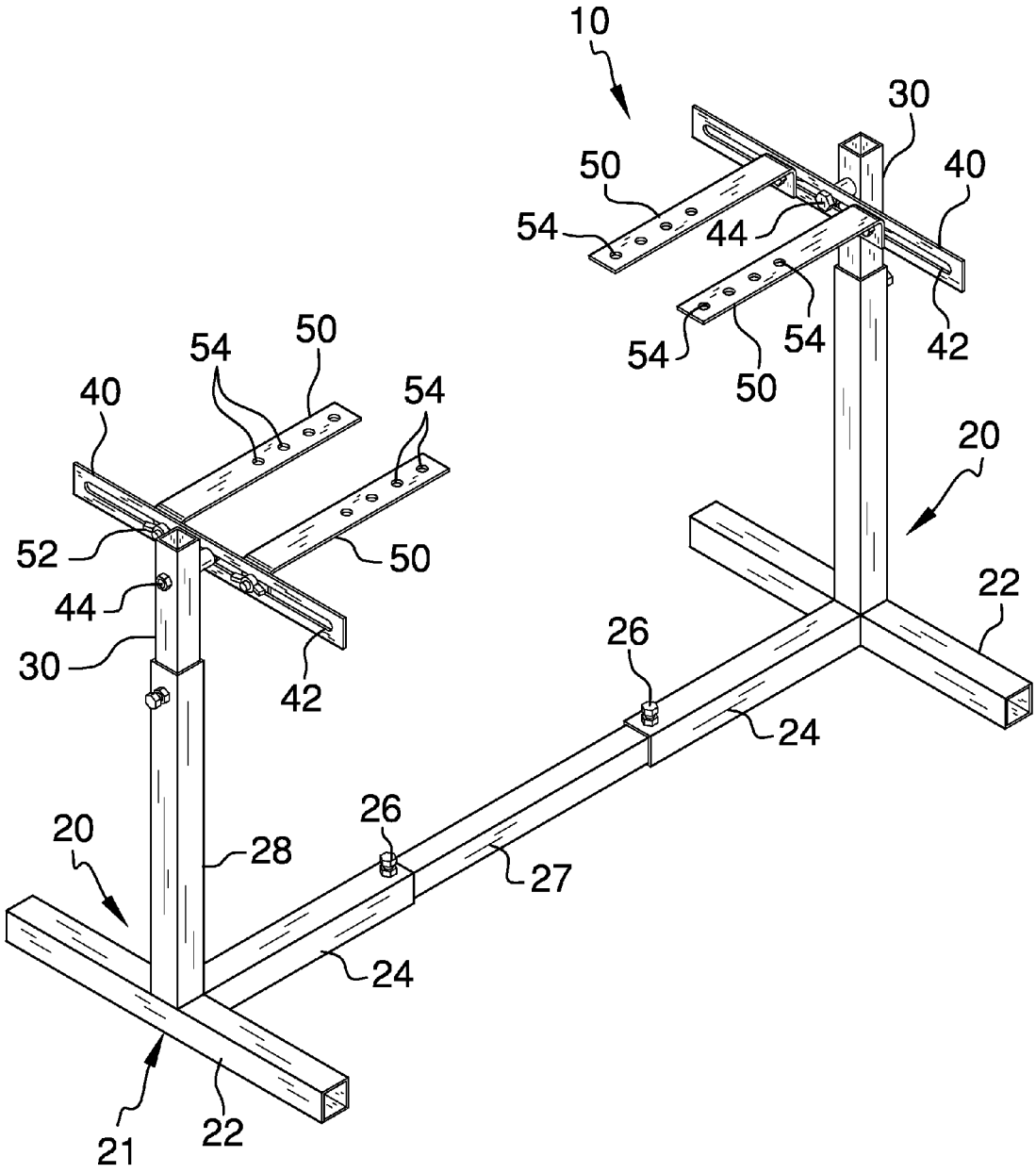
FIG. 2 is a perspective view.

Referring to FIGS. 1 and 2, the apparatus 10 further comprises a pair of identical stands 20. Each stand 20 partially comprises a leg 22. The longitudinal member 24 is perpendicularly extended from the center 21 of the leg 22. The female upright 28 is extended upwardly from the leg 22 center 21.

Continuing to refer to FIGS. 1 and 2 and referring also to FIG. 3, the male upright 30 is slideably disposed within the female upright 28. The position of the male upright 30 is adjustably established by the lock bolt 26. The slotted plate 40 is pivotally held to the female upright 28 via the pivot bolt 44. Loosening the pivot bolt 44 allows the slotted plate to be rotated a full 360 degrees, thereby rotating an RC car 12 as desired. Tightening the pivot bolt 44 locks the slotted plate 40 into a chosen position. The pair of identical horizontal mounts 50 is adjustably held to the slotted plate 40, each mount held by a wing nut and bolt 52. Each mount 50 has a plurality of spaced apart mount holes 54 so that a car 12 can be held to each mount 50 as chosen.

The center member 27 is slideably disposed within the longitudinal member 24 of each stand 20. The apparatus 10 length 23 is adjustably established by a lock bolt 26 within each longitudinal member 24.

With respect to the above description then, it is to be realized that the optimum dimensional relationships for the parts of the remote control car support apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the remote control car support apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the remote control car support apparatus may be used.

Therefore, the foregoing is considered as illustrative only of the principles of the remote control car support apparatus. Further, since numerous modifications and changes will readily occur to those skilled in the art, it is not desired to limit the remote control car support apparatus to the exact construction and operation shown and described, and accordingly, all suitable modifications and equivalents may be resorted to, falling within the scope of the remote control car support apparatus.

What is claimed is:

1. A remote control car support apparatus, comprising, in combination:

a length adjustable to about 27 inches;

a width of about 12 inches;

a height adjustable up to about 16 inches;

a pair of identical stands, each stand comprising:

a leg;

a longitudinal member perpendicularly extended from a center of the leg;

a male upright extended upwardly from the leg center;

a female upright slideably disposed within the male upright, a position of the female upright adjustably established by a lock bolt;

a slotted plate pivotally held to the female upright via a pivot bolt;

a pair of identical horizontal mounts adjustably held to the slotted plate, each mount having a plurality of spaced apart mount holes; wherein the slotted plate is configured to rotate 360 degrees when a remote control car is coupled to the horizontal mounts;

a center member slideably disposed within the longitudinal member of each stand, the apparatus length adjustably established by a lock bolt within each longitudinal member.

* * * * *